United States Patent [19]

Kuehnle et al.

[11] 4,266,869

[45] May 12, 1981

[54] APPARATUS AND METHOD FOR MAKING LITHOGRAPHIC PRINTING PLATES

[75] Inventors: Manfred R. Kuehnle, Lexington, Mass.; Richard E. Cox, Nashua, N.H.; George B. Harris, Jr., Winchester, Mass.; Jess Forrest, Bedford, Mass.; Carl D. Hardy, Medfield, Mass.

[73] Assignee: Coulter Systems Corporation, Ill.

[21] Appl. No.: 10,497

[22] Filed: Feb. 9, 1979

[51] Int. Cl.[3] ..... G03G 15/28

[52] U.S. Cl. ..... 355/8; 355/10; 355/77

[58] Field of Search ..... 355/3 R, 3 CH, 8, 15, 355/10, 11, 77

[56] References Cited

U.S. PATENT DOCUMENTS

| | | | |
|---|---|---|---|
| 3,964,828 | 6/1976 | Yamada et al. | 355/10 |
| 3,972,609 | 8/1976 | Pfeifer et al. | 355/16 X |

*Primary Examiner*—R. L. Moses

*Attorney, Agent, or Firm*—Silverman, Cass & Singer, Ltd.

[57] ABSTRACT

Apparatus for making lithographic plates directly from a copy original which comprises, an enclosure which houses a copyboard, an optical train and a carriage. The carriage moves in a horizontal path beneath a platen carrying a sheet of electrophotographic material. The carriage has a corona device, a slit, a toner device including a bias plate and means for withdrawing excess toner.

The copyboard is loaded in a horizontal position, is moved to a vertical position where a light scanning assembly moves over its face in synchronism with movement of the carriage. The pattern on the copyboard is projected horizontally into a pit or optical chamber where it is deviated upward to cooperate with the slit.

The platen is a cover of the apparatus, can be opened after imaging and toning, the toned electrophotographic member then being removed for further processing.

47 Claims, 16 Drawing Figures

APPARATUS AND METHOD FOR MAKING LITHOGRAPHIC PRINTING PLATES

CROSS REFERENCE TO COPENDING APPLICATIONS

Reference is made herein to different types of lithographic printing plates which can be made or are suitable to be made with the apparatus of the invention, both of which utilize a photoconductive coating of the same kind. Included are plates based upon a substrate that is transparent, flexible synthetic resin sheeting and those based upon a substrate that is opaque, not quite as flexible as the synthetic resin sheeting and is tougher, being sheet metal such as tin-plated cold rolled steel.

These lithographic plates are disclosed and described in detail in the following applications: Ser. No. 870,675, filed Jan. 19, 1978 and entitled "Direct-imaging, Flexible Offset Printing Plate and Method of Manufacture"; Ser. No. 973,241, filed Dec. 26, 1978 and entitled "Printing Plate for Lithography and Method of Making the Same".

Both of the above applications are owned by the assignee of this application.

FIELD AND BACKGROUND OF THE INVENTION

The field of this invention comprises apparatus and a method for the manufacture of printing plates which are to be used in lithographic offset printing.

Specifically the invention is concerned with the direct manufacture of lithographic printing plates using electrostatic techniques at high speed. The plates produced by the apparatus and method of the invention are superior to printing plates made by known methods whether photographically or electrostatically.

Lithographic printing plates made by the conventional photographic methods are expensive and complex; plates made by electrostatic methods which are known have never been widely used because they require considerable time to produce, have very little life and are low in resolution and spectral response. The latter two disadvantages are characteristic also of photographically made lithographic plates.

Lithographic printing is a process which is basically very old and well-known. For many years, even well into this century, the technique was practiced on special stone surfaces. A greasy image was applied to a surface, the non-imaged portions being rendered hydrophilic (water attractive, oil repellant). The imaged parts being hydrophobic (water repellant, oil attractive) when a paper receptor is pressed against the surface which has been wetted with water and the greasy ink, the greasy ink having adhered only to the image will be transferred to the paper.

In this process, since the only difference between the imaged and non-imaged areas is the presence of ink on the imaged areas, there is substantially no difference in height between the two areas, this type printing also being known as planographic. In this case of the classic method of letter press printing the imaged areas are in relief above the non-imaged areas or intaglio, that is engraved below the non-imaged areas.

Offset lithography is probably the most important method of printing today. The principle is that ink is offset first from the plate to a rubber blanket and then from the blanket to the paper receptor. There may be an intervening metal drum instead of a rubber blanket.

When the printing plate is made, the printing image is rendered hydrophobic, i.e., repellant to water but also attractive to grease. The non-printing areas are rendered just the opposite, that is, hydrophilic. On the press the plate is mounted on a plate cylinder which, as it rotates, comes into contact successively with rollers wet by a water or dampening solution and rollers wet by grease-based ink. The dampening solution wets the non-printing areas of the plate and prevents the ink from wetting these areas. The ink wets the image areas which are transferred to the intermediate blanket cylinder. The paper picks up the image as it passes between the blanket cylinder and the impression cylinder.

In order to appreciate and understand the nature and advantages of this invention, one should comprehend the problems which are a necessary adjunct to the manufacture of a lithographic plate by conventional methods.

Offset plates of conventional construction of the type expected to make many thousands of impressions are expensive to manufacture. Ink receptivity is accomplished by using inherently oleophilic (having an affinity for oil) resins or metals like copper or brass on the image areas. Water receptivity of the non-image areas is usually achieved by using hydrophilic metals like chromium, aluminum or stainless steel and this receptivity is maintained in platemaking and storage by using natural and synthetic gums such as for example, gum arabic.

All offset printing plates which are used for long runs exceeding several thousands of impressions are made by indirect imaging methods. The copy or intelligence is first required to be photographed onto silver halide film and the film negative then used to transfer the image to the printing plate. The transfer is accomplished in all such cases by means of photographic projection onto a coating which is light sensitive and carried by the plate. The negative is used to project the image onto the plate and the processes which follow for the development of the image on the plate vary. Thus, the plates are required to be stored in darkness until used or the light-sensitive coating applied just before use. This is true of the three types of long-run offset plates which are most popularly used today.

The three types of long run plates which are known at this time are surface, deep etch and bimetal. The surface plates are those in which a light-sensitive coating is exposed to a negative, developed etc. The process of achieving the plate requires many steps and treatments. On deep etch plates, after exposure to the negative, the coating in the image areas is removed and coppered chemically and/or lacquered and inked so they are ink receptive. The plate is usually aluminum and the process is quite involved and requires considerable skill. Bimetal plates are similar to deep etch in that the light sensitive coating is removed from the image areas but these areas consist of copper or brass.

By reasons of the planographic nature of lithographic plates, electrostatic techniques would seem to lend themselves to the making of such plates. The toned images on a receptor or a photoconductive surface would seem to form the basis for hydrophobic and hydrophilic areas, respectively, but until the invention of the plates of the two copending applications, this has not been realized. Prior attempts, as for example using the zinc oxide electrophotographic member have not been successful.

Among the difficulties encountered have been low sensitivity, low resolution, mediocre quality, slow speed of manufacture, inability to stand up to wear on a printing press and limited chromatic response. Even conventional lithographic plates are normally exposed only with ultraviolet light and have limited chromatic response. Text and graphics must be separately produced on the plate by complex methods.

Given a metal or polyester based lithographic printing plate of the character described in the copending applications in which the photoconductive coating is as disclosed in U.S. Pat. No. 4,025,339, most, if not all of the disadvantages of prior lithographic printing plates are overcome. There is, however, another group of problems which must be solved in order to make such plates available for use in modern printing shops.

The plates of the copending applications require uniform charging over large areas, exposure over these same areas, toning and fixing. The exposure must be capable of accomplishment in a reliable manner by one who is not necessarily skilled in electrostatic techniques. It must be done routinely, with despatch. The apparatus used must handle copy originals conveniently and the processes to be effected must be done in such a manner that the many attributes of the plates of the copending applications are achieved.

Further, the apparatus must be simple, occupy little space, and produce uniform results every cycle of its operation.

These, then, are the ends sought by the invention, along with other advantages to be detailed and pointed out hereinafter. For example, the apparatus and method of the invention are capable of being used to make a metal or a polyester based lithographic printing plate in the same machine or one which is readily modified to produce one or the other.

SUMMARY OF THE INVENTION

Apparatus for making lithographic printing plates directly from a copy original comprising a light-tight enclosure whose component parts perform all functions needed to deliver a plate, either fully treated and ready for mounting on a press or in condition to be treated by a single bath of etchant and thereby made ready for the press.

A copyboard is mounted horizontally at the top of the enclosure in convenient location to receive a copy original thereon which may be held in place by vacuum. The copyboard swings to a substantially vertical disposition where it can be scanned progressively by a lamp, from its face and/or its rear if the copy original is transparent. An optical train provides for projection of the subject matter of the original onto a charged electrophotographic member by way of a window or slit that moves over the sensitive surface of the electrophotographic member in synchronism with the scanning of the original.

The electrophotographic member may comprise a flexible article based upon a polyester substrate that is transparent or upon a substrate comprising sheet metal that is not as flexible and opaque, the surface of the electrophotographic member that is exposed to the sweeping light beam comprising in each case a sputtered coating of a wholly inorganic photoconductor that has a crystalline structure and is capable of being rapidly charged, imaged and toned. The electrophotographic member is carried or a hinged platen which is also located at the top of the enclosure but spaced from the "home" position of the copyboard. The hinging arrangement enables the user to mount the electrophotographic member horizontally in ambient light and then to rotate the mamber 180° into an aperture in the enclosure while simultaneously closing the aperture, the photosensitive coating side facing into the enclosure.

The slit or window is provided in a carriage which has a charging device, said window, a toning device and excess toner removal means all moving together with the carriage across the photosensitive surface of the electrophotographic member. A heat lamp may be provided for fixing the toned image.

The carriage moves from its "home" position across the electrophotographic member toward the home position of the copyboard and then back to its "home " position after the lithographic plate has been completed.

The plate may be treated with etchant in the apparatus or after removal therefrom, preferably the latter.

DESCRIPTION OF THE PREFERRED EMBODIMENT

Figure 1:
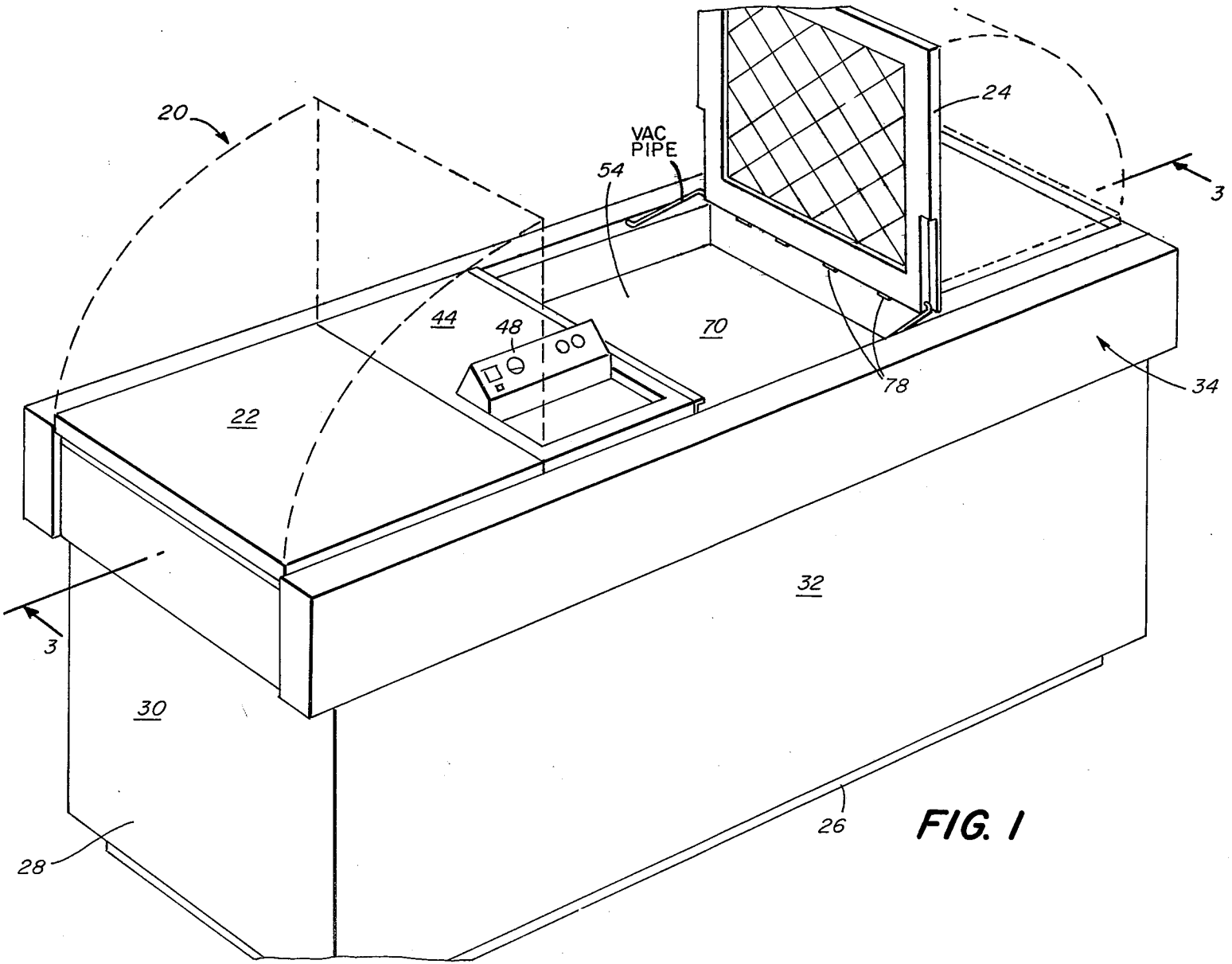
FIG. 1 is a perspective view of an apparatus for making lithographic printing plates constructed in accordance with the invention.

General Description of Overall Apparatus and Method

The apparatus of the invention may be considered a camera or projector combined with an electrostatic plate making processor. The camera is invested with the task of responding to the light which is produced by illuminating a so-called copyboard upon which there has been placed or secured a variegated pattern which it is desired to project onto a surface. The pattern is in effect a copy original and may comprise a single member or multiple members. There may be graphics in the form of photographs, drawings or diagrams. There may be text, captions, headings, numerical columns or the like. There may be opaque, translucent or transparent articles or members. There may be a negative film, a positive film or mixtures. These may be taped to the copyboard or clamped between the copyboard and a glass coverplate which is hingedly secured to the copyboard. They may be mechanically or adhesively held in place or may be secured by vacuum which is effected by having the copyboard provided with suitable grooves, openings and the like connected to a source of vacuum.

The copyboard is disposed under a cover at one end of the apparatus and is available in a horizontal position when the cover is open. After the pattern has been affixed, the copyboard is driven from its horizontal position adjacent the top of the apparatus to a vertical position down inside of the apparatus, with the pattern facing the lens system which is provided in the center of the apparatus. Movement of the copyboard between its horizontal and vertical positions is under the manual control of the operator.

After the copyboard is vertically disposed in position to be illuminated by a pair of scanning lights that is provided, the operator may move to the opposite end of the apparatus to position and mount the plate which is to be made carrying the pattern of the material that is carried on the copyboard.

The apparatus has a platen at the end opposite the copyboard which is mounted on the bottom of a hinged cover member. When the cover member is swung open, it exposes the platen which is provided with a clamp and vacuum grooves and openings. When the cover member is swung to a closed position it closes off the upper part of the apparatus near its end, there being a partition between the platen end of the apparatus and the copyboard end of the apparatus within which there is mounted a lens system.

The plate which is being made is formed on a rectangular member of photographic material which may be based upon metal or plastic film such as polyester. The operator swings the platen-cover open, clamps the electrophotographic member in place on the platen, turns on the vacuum and swings the cover closed. The photoconductive coating of the electrophotographic member is exposed when the member is mounted on the platen and thus, when the cover member is swung to a closed position, the photoconductive surface will be facing downward.

At this point the copyboard is arranged vertically and the photoconductive surface is arranged horizontally.

The camera aspect of the apparatus now comes into play. There is a scanning assembly which comprises a mounting for lights arranged straddling front and back of the copyboard and capable of bein mechanically driven to scan the copyboard and hence the pattern on its surface from the bottom to the top. The illuminated pattern is viewed as a moving strip or horizontal band by the lens system which is pointed at the copyboard, the resulting image being projected through the lens system to a pit or chamber whose upper end is closed off by the platen. A diagonal mirror in the wall of the pit opposite the lens system diverts the image projected upward toward the platen.

When the operator starts the automatic aspect of the apparatus, there is a carriage which is normally in its home position beneath the open position of the platen. This carriage includes at its leading edge a high voltage corona device in the form of reciprocating wires stretching across the width of the carriage normal to the direction of its movement. Following the corona wires there is a slit which is open through the carriage and which exposes a strip of the photoconductive surface of the electrophotographic member as the carriage moves. Next after the slit there is a wide metal plate which provides a toning bias and which carries a flowing layer of liquid toner supplied by a sump beneath the plate and brought up to the plate by a roller that is immersed in the sump. Following the roller there is a vacuum slot which sucks excess toner from the toned member and following the vacuum slit is a relatively wider nozzle from which air under pressure is expelled against the toned plate, the arrangement being such that the air tends to drive excess dripping toner into the vacuum slot and dry the toned image.

The carriage and the scanning assembly move simultaneously, the scanning assembly moving from the bottom of the vertically arranged copyboard to its top end and illuminating a swath of the pattern progressively while the carriage moves along the length of the electrophotographic member.

At the end of the movements of the scanning assembly and the carriage, both return to their home positions and the automatically programmed portion of the operation is completed. The various functions of the equipment which are not necessary are turned off and the plate is substantially completed.

The platen cover is now opened, the plate examined and if satisfactory is removed. It will be fairly dry even without having been subjected to fixing or fusing. This is because of the stream of air flowing from the nozzle. The apparatus is capable of carrying a fusing device on the carriage or having one located at the end of the forward stroke of the carriage, but it is preferred that the fusing not be complete so that the plate may be corrected by the operator if he desires before fixing.

The operator may leave the copyboard in position vertically if he desires to make another plate of the same pattern or he can throw a switch to bring the copyboard back to its upper horizontal position so that he can apply another pattern thereto after removing or modifying the one in place.

One important feature of the apparatus is that the copyboard is a part of a module which is movable along suitable tracks provided on the frame or chassis of the apparatus in order properly to focus the projected image upon the plate. The module is self-contained in that it includes the copyboard, the guide means for movement of the copyboard between its horizontal and vertical positions, the drive motor and belts for moving the copyboard, the entire light scanner assembly with its guides and driving motor and belts and means for connecting the module into the entire system such as plugs, connectors and the like. When the module is properly located for the focus that is desired, means are provided to clamp the module to the rails of the framework of the apparatus.

THE CHASSIS AND FRAMEWORK

Reference may be had to FIG. 1 which is a general perspective of the apparatus of the invention. The apparatus is designated by the reference character 20 and in this view it is shown in a condition with the copyboard cover 22 closed and the platen cover 24 half way open.

The platemaker apparatus 20 is formed of a bottom pedestal 26 upon which is mounted the main chassis or framework 28. In FIG. 1 the main chassis is shown as a relatively elongate enclosure whose exterior may be ornamental and comprised of panels such as the end panel 30 and the front panel 32. The interior framework will however be formed of robust steel members as shown at 37 in FIG. 2 suitably welded or bolted together to provide a rigid and stable platform for the apparatus, considering, of course that there is included an effective camera with a long focal length and that sharp reproductions of the patterns are desired.

Figure 2:
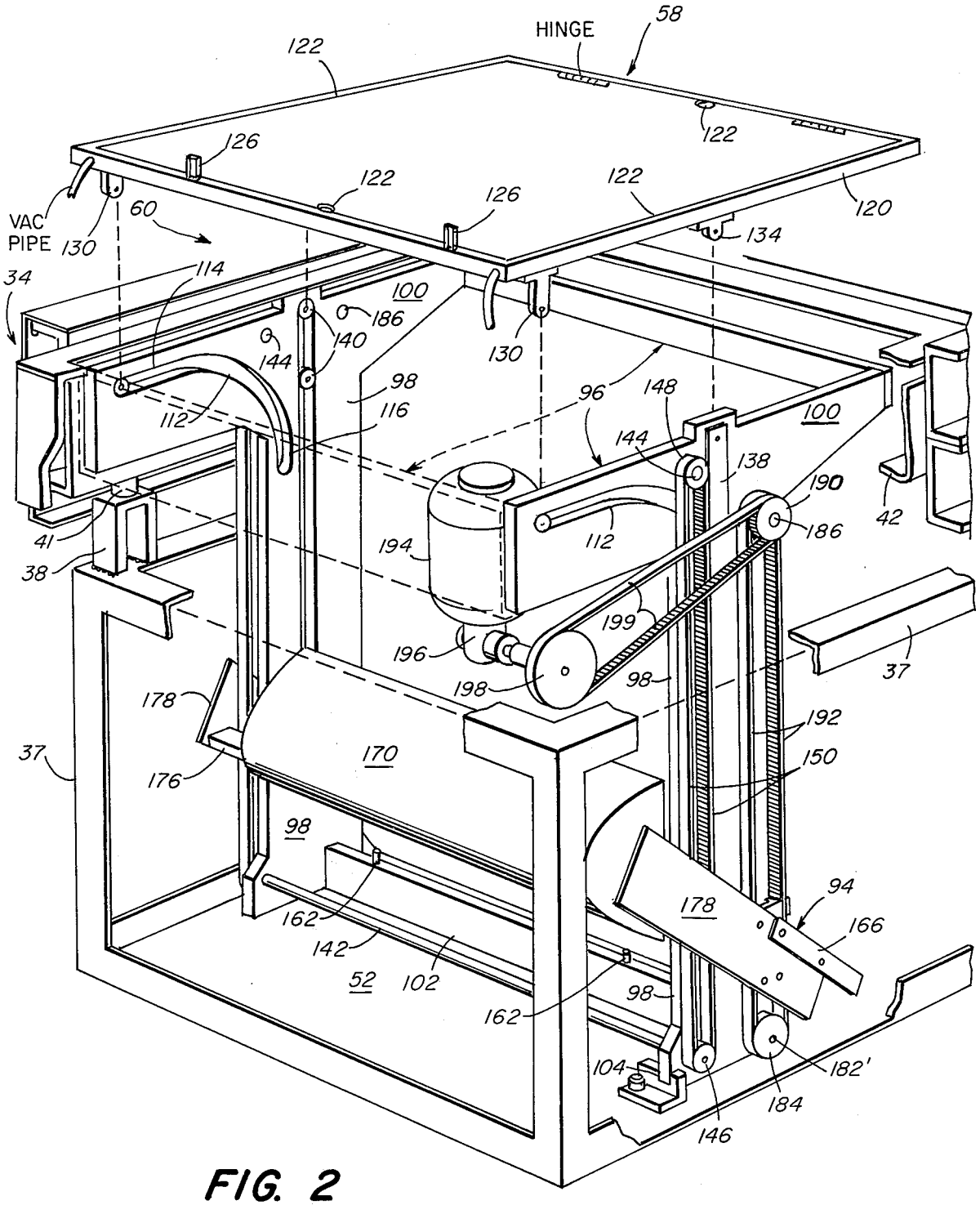
FIG. 2 is a perspective view of the apparatus of FIG. 1 but of the left hand portion thereof with some of the outer panels removed to illustrate the framework.

The upper part of the main chassis 28 has a subchassis mounted thereon, the subchassis being designated generally as 34 in FIG. 1. The subchassis 34 includes rails and tracks which are provided for several pruposes. Typically as shown in FIG. 2 there is a plurality of brackets such as the inverted U-shaped bracket 38 welded to the upper structural members 37 and having structural rails 40 of the subchassis 34 bolted thereto by means of shock mountings 41 which may include elastomeric bushings. The structural rails 40 may include interior tracks such as shown at 42 upon which the copyboard module may be moved and secured.

Figure 3:
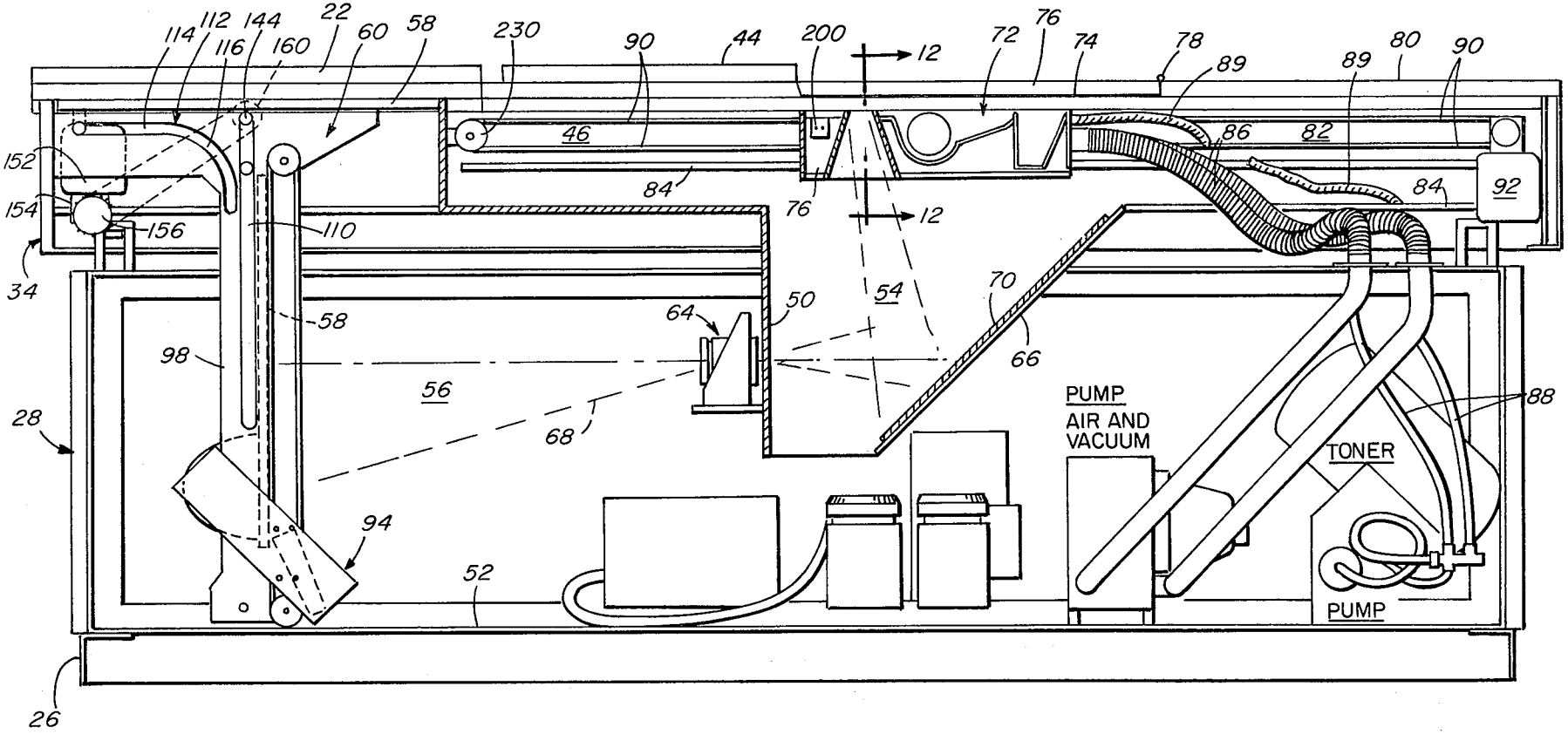
FIG. 3 is a vertical median sectional view through the apparatus of the invention, taken generally along the line 3—3 of FIG. 1 and in the indicated direction.

There is a central cover member 44 on the upper face of the platemaker 20 which remains permanently in place overlying and forming with other structural members the terminal position chamber 46 of the carriage which has been briefly described above. Reference may be had to FIG. 3 which is a median sectional view along the length of the platemaker 20 for the relative position of the chamber 46 with respect to the other components of the apparatus. The cover member 44 is considered to be located to the rear of the apparatus 20 because the operator will stand in front of the apparatus 20 facing the panel 32 or at one end or the other during use of the apparatus.

Forward of the cover member 44 and also overlying a portion of the terminal position chamber 46 is an instrument and control panel 48 which includes a housing for the gauges and switches required to control and operate the apparatus 20.

There is a central partition or generally vertical wall 50 which extends downward from the chamber 46 toward the bottom floor 52 of the chassis 28, this partition 50 serving as one wall of the pit or projection chamber 54. The wall 50 also separates the copyboard end of the interior of the device from the projection chamber 54, such end being generally referred to as the copyboard projection chamber 56.

The copyboard 58 is disposed in the copyboard chamber 56 and it generally is associated with the copyboard module 60 which, as previously stated, is in the form of an independent module that can be manufactured separately from the remainder of the apparatus 20 and then incorporated therein. As will be explained, the copyboard module 60 is mounted on tracks 42 and adjusted for proper focus after which it is clamped in place by suitable clamps as indicated at 62.

The central partition or wall 50 serves another function, being the support for the lens system 64 by means of which the pattern on the copyboard 58 is projected to the pit or chamber 54.

The pit 54 has a back wall 66 which is arranged at a 45° angle relative to the vertical so that the rays indicated at 68 which originate at the illuminated copyboard 58 will be received on a mirror 70 mounted on the interior of the wall 66 and be projected upward to the slit in the carriage 72.

The carriage 72 will be described in detail hereinafter but at this point should be understood to comprise an assembly of components which move together in a predetermined path for the purpose of imaging the plate 74 which is mounted on the platen cover 76 facing downwardly. Note that the platen cover 24 is hinged at 78 so that it can be swung from a position in which it is folded back upon the top panel portion 80 of the subchassis 34. This is indicated by the arcuate broken lines of FIG. 1.

The copyboard chamber is adapted to be closed off by the cover member 22 that also swings as indicated by the broken lines of FIG. 1.

The carriage 72 moves from its home position in a suitable enclosed chamber 82 upon guides 84 which are mounted to the tracks 42 from its home chamber 82, out over the pit 54 and into the terminal position chamber 46. It is connected to various devices which are mounted in the enclosure of the chassis 28, for the most part disposed on the base 52. Primarily there are flexible hoses 86 connecting to the vacuum and air pressure devices and the toner circulating pipes 88. These may be separate or within one another. Flexible wires 89 connect to sources of power in the body of the apparatus.

The carriage 72 is driven by belts 90 which engage over sheaves that are in turn rotated by connection with a motor 92 mounted in the chassis 28. The belts are clamped to the carriage 72.

As explained in the general discussion above, the principal effect of movement of the carriage 72 is to sweep a slit over the face of the plate 74, this slit in turn being supplied with illumination derived from the pattern mounted on the copyboard 58. The copyboard 58 synchronously is strongly illuminated by the lamps of a scanning assembly 94 that moves upward while the carriage is moving from the chamber 82 to the chamber 46.

THE COPYBOARD AND COPYBOARD MODULE

The structure which is illustrated includes the concept of a copyboard module 60 which is an independent article that can be made outside of the device 20 and then mounted in the device upon the tracks 42, adjusted in position and secured in that position which is the optimum for the focus which is desired relative to the lens system 64. It should be understood that the copyboard 58 need not be incorporated into a module but could be constructed to operate as a permanently connected portion of the device within the scope of the invention. The module concept provides additional advantages to the basic benefits of the invention achieved through the copyboard arrangement which calls for the movement of the copyboard between its two positions. Accordingly, the structure which is hereinafter detailed is only to be considered exemplary.

The copyboard module 60 is constructed as a generally rectangular metal frame 96 which fits upon the tracks 42 and can slide thereon. The clamps 62 engage the bottom of the tracks to secure the frame 96 in place when the desired location is reached. The frame 96 has a pair of vertical standards 98 which are integral with the sides of the frame 96 and which depend from the respective opposite sides. The structural arrangement is effected by forming the standards 98 of heavy metal members of generally T-shaped configuration, the crossbar of the T being indicated at 100, then welding or otherwise securing the standards to the sides of the frame 96.

At the bottom ends of the standards there is provided a robust crossbar 102 which is secured to the respective standards 98 to maintain their lateral spacing. This crossbar 102 is slidably engaged rather closely in a slot 104 formed in an angle anchor bracket 106 that is bolted to the floor 52 of the chassis 28 by a machine screw and slot arrangement 108 that permits of lateral adjustment. When the module 60 has been properly positioned this described connection prevents lateral vibration of the bottom ends of the standards 98.

Each standard 98 is provided with a pair of copyboard guide slots comprising a vertical slot 110 that extends along the length of the vertical portion of the standard 98 and an arcuate slot 112 that is located in the crossbar 100 of the T closest to the left hand end of the device 20. This latter guide slot has a generally horizontal portion 114 and a curved portion 116 that terminates in the vertical part of the standard 98. There are precisely located slots in opposite standards 98.

The copyboard 58 comprises a transparent rectangle of glass or the like set into a metal frame 120 which has the grooves, openings and the like as indicated at 122 which are connected to a source of vacuum by flexible pipes which do not interfere with the movement of the copyboard. There is a glass cover 124 which is hinged to the frame 120 and can be locked in place on the frame by suitable fasteners indicated at 126. The pattern is formed by the materials indicated at 128 which may be adhered to the glass 118 and/or clamped in place by the glass cover 124 with or without the assistance of vacuum.

At opposite edges of the frame 120 there are provided a pair of brackets, there being a total of four such brackets. Two of them indicated at 130 carry rollers 132, these brackets being located close to one end of the edge of the frame 120. The brackets 134 are located close to the center of the edge of the frame 120 and have the rollers 136. Brackets 130 are longer than the brackets 134 so that the rollers 132 are spaced further from the frame 120 than the rollers 136. The rollers 132 are mounted for guiding movement in the respective arcuate slots 112 while the rollers 136 are each mounted to a small truck 138 which carries two spaced rollers 140 that are engaged in the vertical slots 110. The truck 138 is always disposed vertically because of the spaced rollers 140 that are confined in the slot, but the frame bracket 134 is free to rotate relative to the truck 138.

At the bottom and top ends of the standard 98 there are provided shafts 142 and 144 to the ends of which there are secured sheaves, the bottom sheaves being designated 146 and the top sheaves being designated 148. The bottom shaft extends fully across the intervening space between the standards 98 but the top shafts 144 are stub shafts, unconnected to one another. A belt 150 extends between each pair of sheaves on opposite sides of the module 60, the belts preferably being toothed and the sheaves having suitable teeth to engage with the belts.

There is a drive motor 152 located in the upper corner of the module 60 toward the rear thereof, having a reduction gear box 154 driving a sprocket wheel 156. A sprocket chain 158 engages the sprocket wheel 156 and extends to a second sprocket wheel 160 that is secured to the upper rear stub shaft 144. The belts 150 are clamped to the trucks 138 so that rotation of the stub shaft 144 by energizing the motor in one direction or another will cause the trucks 138 to slide up or down in the slots 110. Since this truck is secured directly to the rollers 136, the frame 120 of the copyboard will be driven up and down as to the location of the rollers 136, but because the ends of the frame are secured to the rollers 132 and must follow the arcuate slots 114, the copyboard 58 will move in a motion which is dictated by the two slots.

Figure 4:
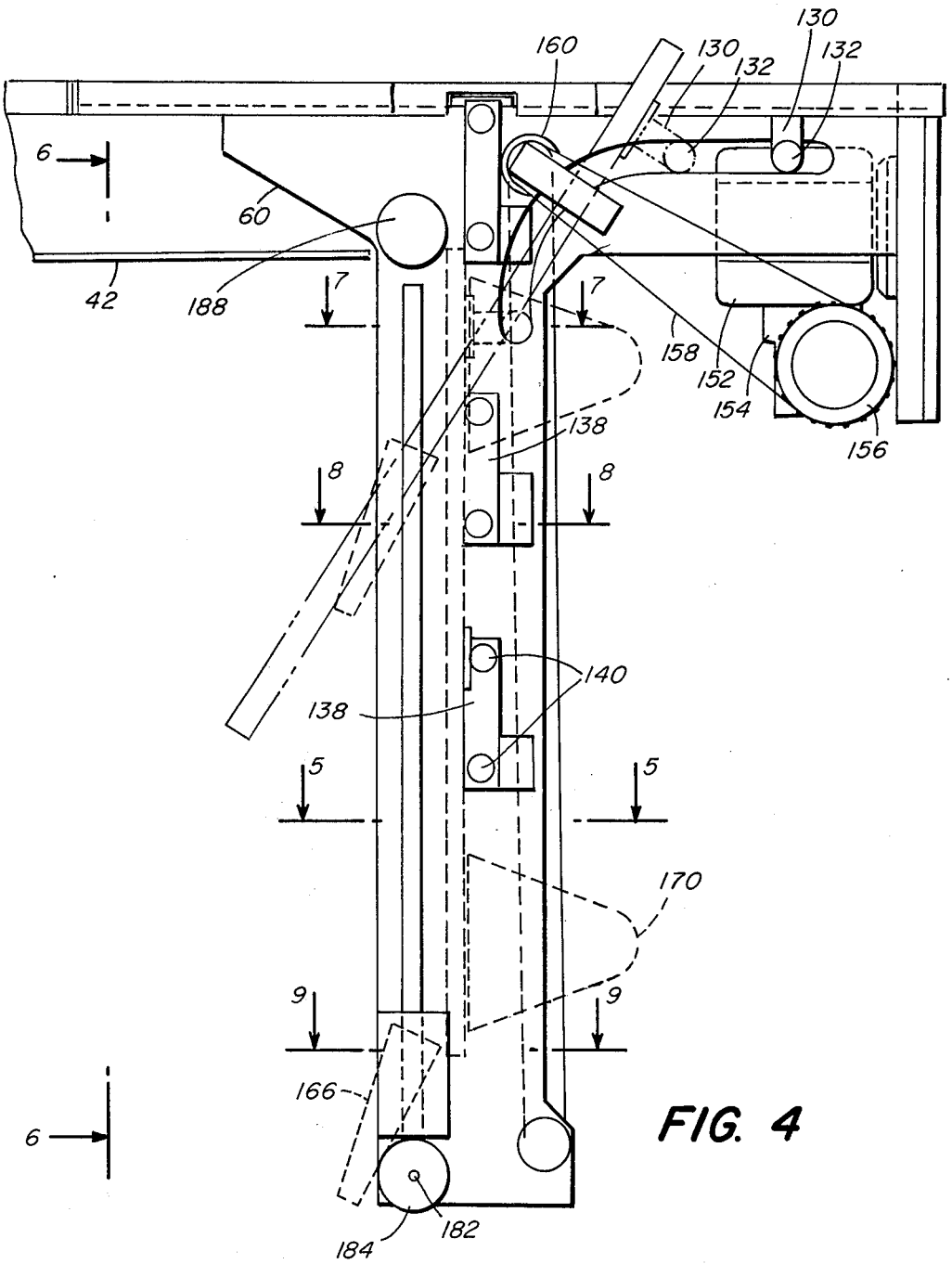
FIG. 4 is a fragmentary sectional view similar to FIG. 3 but of the left hand end thereof.
Figure 5:
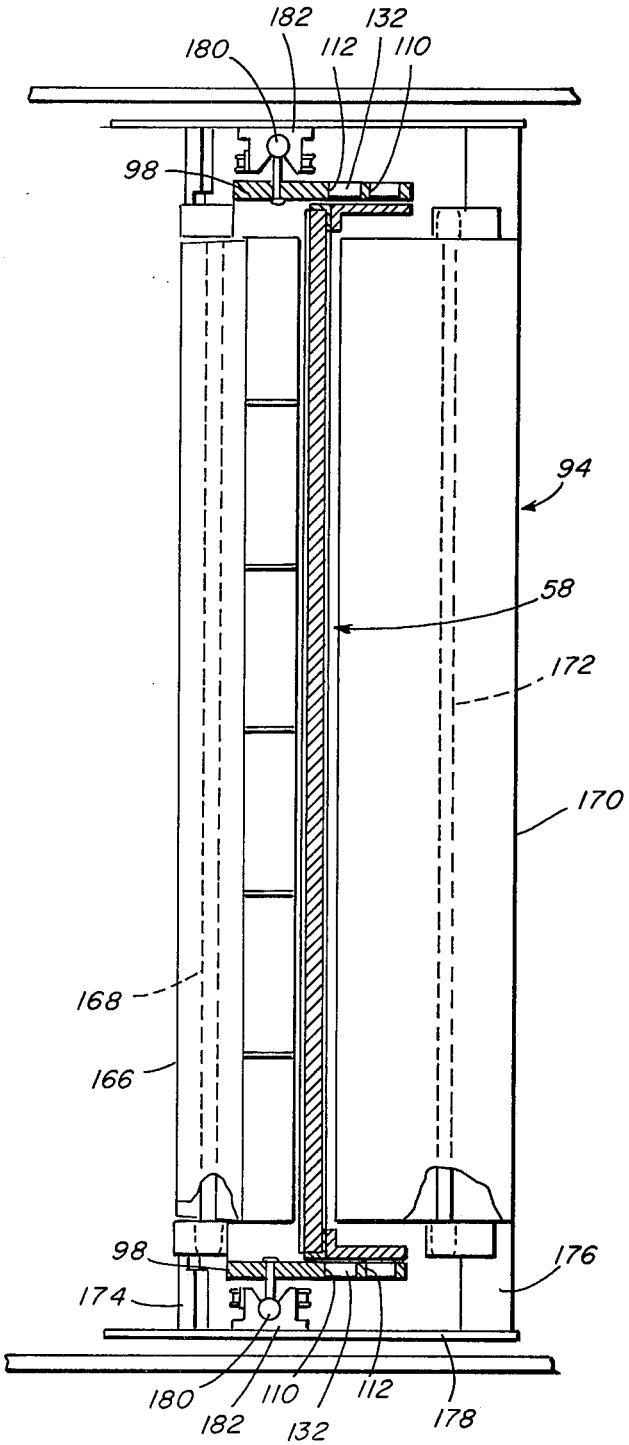
FIG. 5 is a sectional view through FIG. 4 along the line 5—5 and in the indicated direction.
Figure 6:
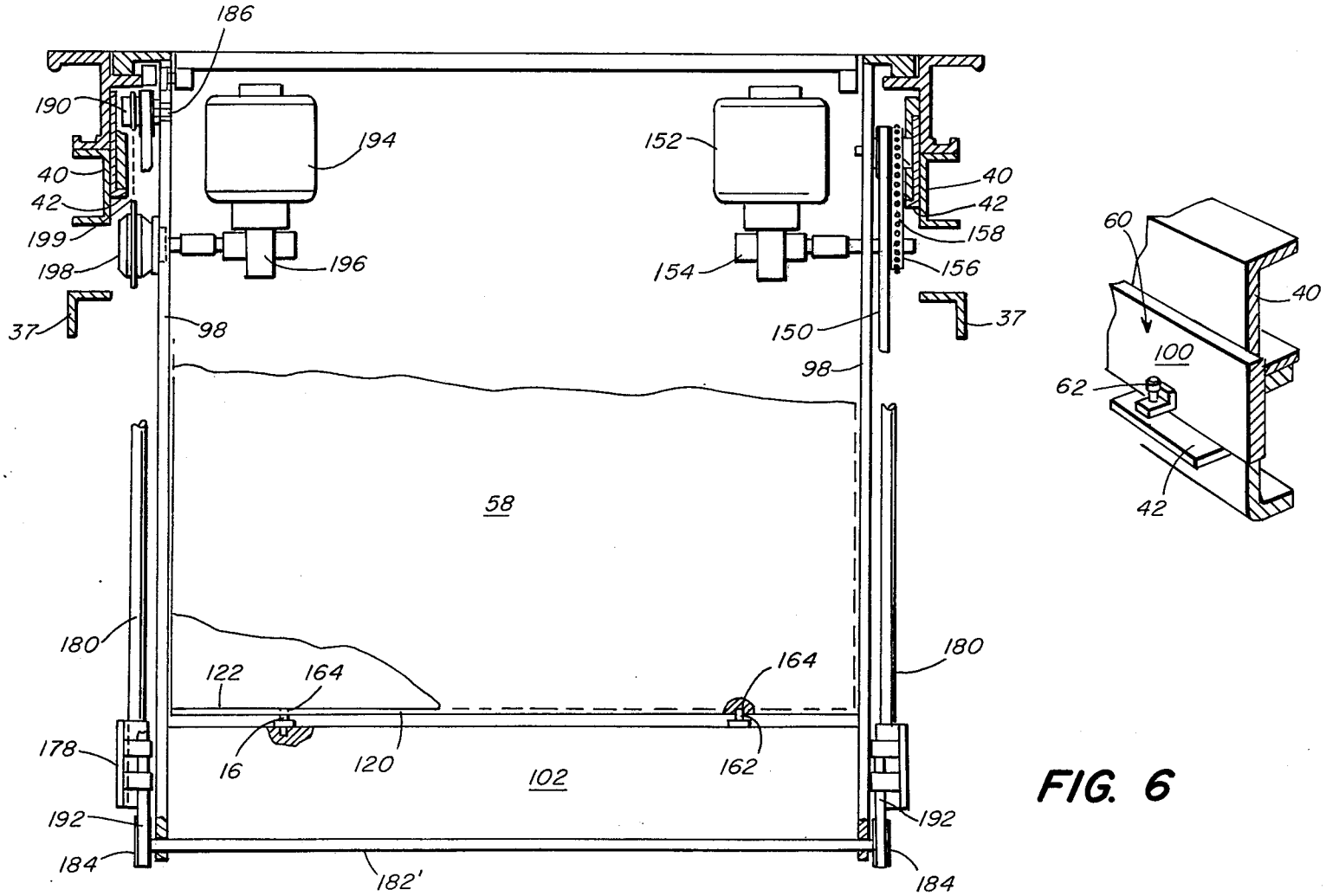
FIG. 6 is a fragmentary vertical sectional view taken generally along the line 6—6 of FIG. 4 and in the indicated direction.
Figure 7:
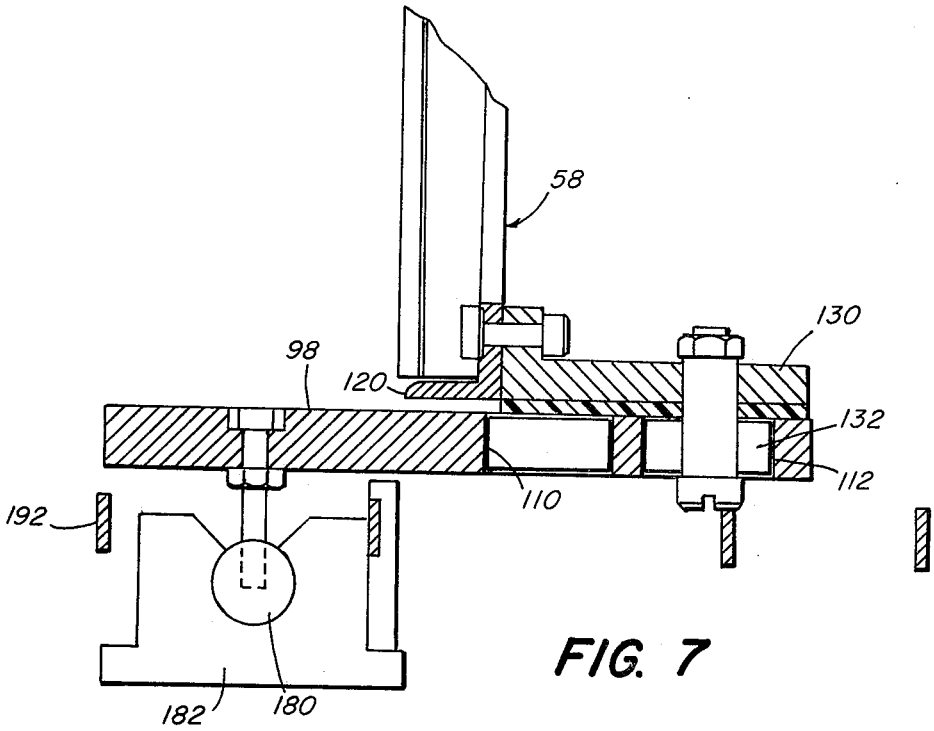
FIGS. 7, 8 and 9 are sectional views taken generally along the lines 7—7, 8—8, and 9—9, respectively of FIG. 4 and in the indicated directions.
Figure 8:
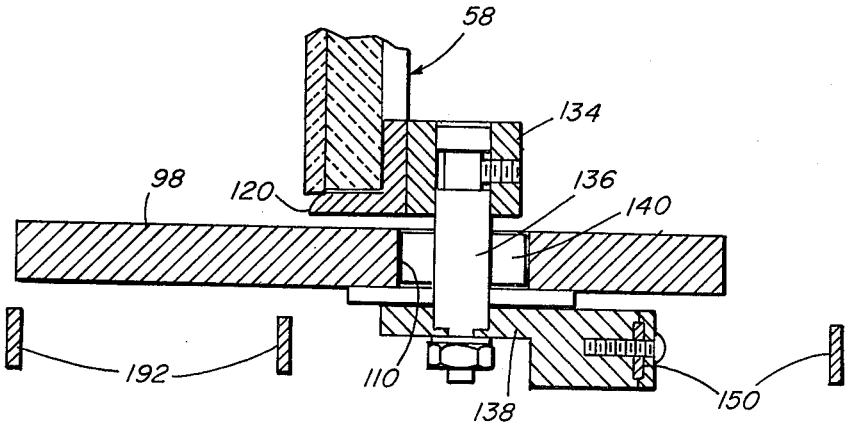
Figure 9:
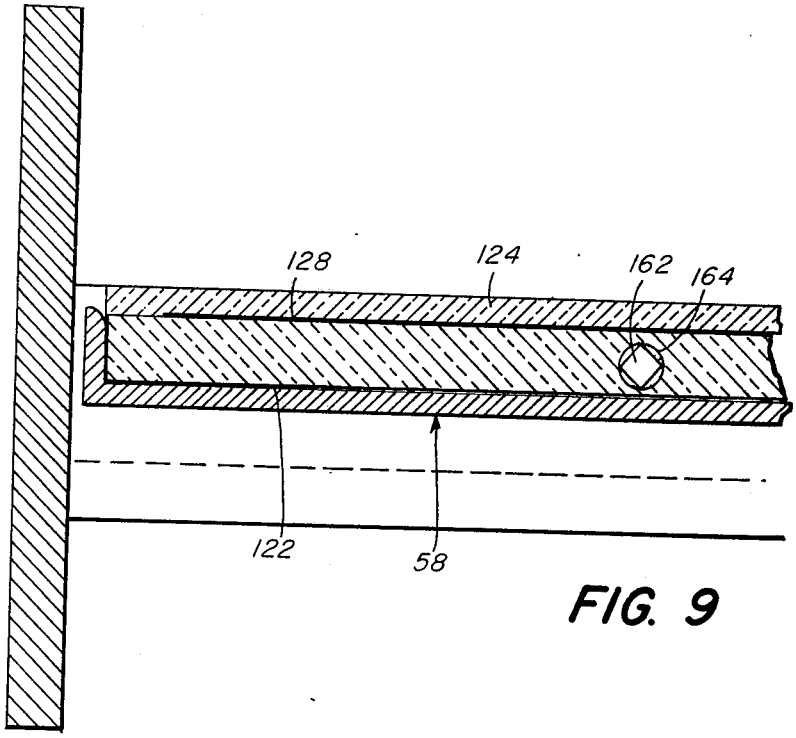
Figure 10:
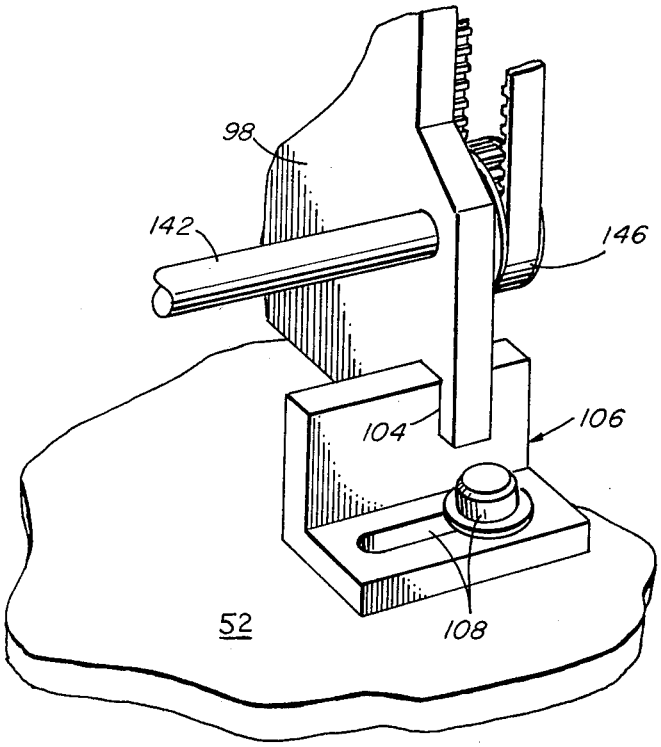
FIG. 10 is a fragmentary perspective view of the anchor bracket for retaining the standards.

The copyboard 58 is suspended between the rollers 132 and 136 and thus will move within the standards 98. When the trucks 138 are driven to the top of the slots 110, the rollers 132 will carry that end to which they are mounted along the slots 112 toward the horizontal portions 114 and the copyboard will assume a horizontal position which is illustrated in FIGS. 4 and 5. When the trucks 138 are driven toward the bottom of the slots 110, the rollers 132 will follow the arcuate slots 112 from the horizontal portions 114 to the vertical portions 116 as a result of which the copyboard will move to a vertical position as shown in FIGS. 4 and 5. In this latter position, it is disposed to be scanned for projection of the pattern 128 to the pit 54.

When the copyboard 58 is in its vertical position, the then bottom end of the frame 120 is located at the upper edge of the crossbar 102 and pins 162 set into the upper edge of the crossbar 102 engage in location holes 164 in that portion of the frame 120. This aids in precisely fixing the location of the copyboard 58 for accurate projection of the pattern thereon.

The module 60 also includes a scanning assembly whose purpose is to illuminate the pattern on the copyboard 58 progressively as the carriage 72 moves across the pit 54.

The scanning assembly 94 is formed of a front reflector 166 that extends fully across the front of the copyboard 58 and includes a tubular lamp 168 that faces the pattern and a rear reflector 170 that extends fully across the rear of the copyboard 58 and has its own tubular lamp 172. Thus, there are reflectors on the front and rear of the copyboard when it is in its vertical disposition. The reflectors and lamps are mounted to bars 174 and 176, respectively that extend between metal plates 178. These plates are located outside of the standards 98 but are quite close thereto. A vertical rod 180 is secured to each standard on the outer face thereof and each rod has a slide 182 which is mounted thereto. The plates 178 are slidably secured to the respective slides. A shaft 182 extends across the module 60 between the bottom ends of the standards and a sheave 184 is secured to each of the ends of the shaft 182. At the upper ends of the standards 98 there are stub shafts 186 which carry sheaves also, but the rear sheave 188 is a single sheave while the front sheave 190 has two grooves. Belts 192 extend between the sheaves 188 and 190 and are clamped to the slides 182. A drive motor 194 mounted on the frame 120 has a gear reduction box 196 with a drive wheel 198 and a belt 199 extending between the sheave 190 and the drive wheel 198. Energizing the motor 194 to rotate in one direction or the other will remove the assembly 94 up or down illuminating the copyboard from front and rear if the lamps 168 and 172 are lit.

THE CARRIAGE AND ITS COMPONENTS

The carriage 72 is an assembly which is made of sheet metal and has several important components. At its front end there is an upwardly opening trough or chamber 76 which carries corona wires 200 extending along its length, that is, transverse of the direction of movement of the carriage 72. The carriage moves to the right and left as viewed in FIG. 11. These corona wires 200 may be mounted to a reciprocating support. Next along the carriage 72 toward the right is a slit or aperture 202 which opens to the top of the carriage and is intended to sweep across the electrophotographic member or plate 74 as it can be called during the movement of the scanning assembly 94 in order to expose the plate 74 progressively. It will be seen that the entrance to the slit is tapered, the taper being indicated by the walls 204 so that the rays of light 68 reflected from the mirror 70 will be unobstructed in impinging against the plate surface.

Figures 11, 11A:
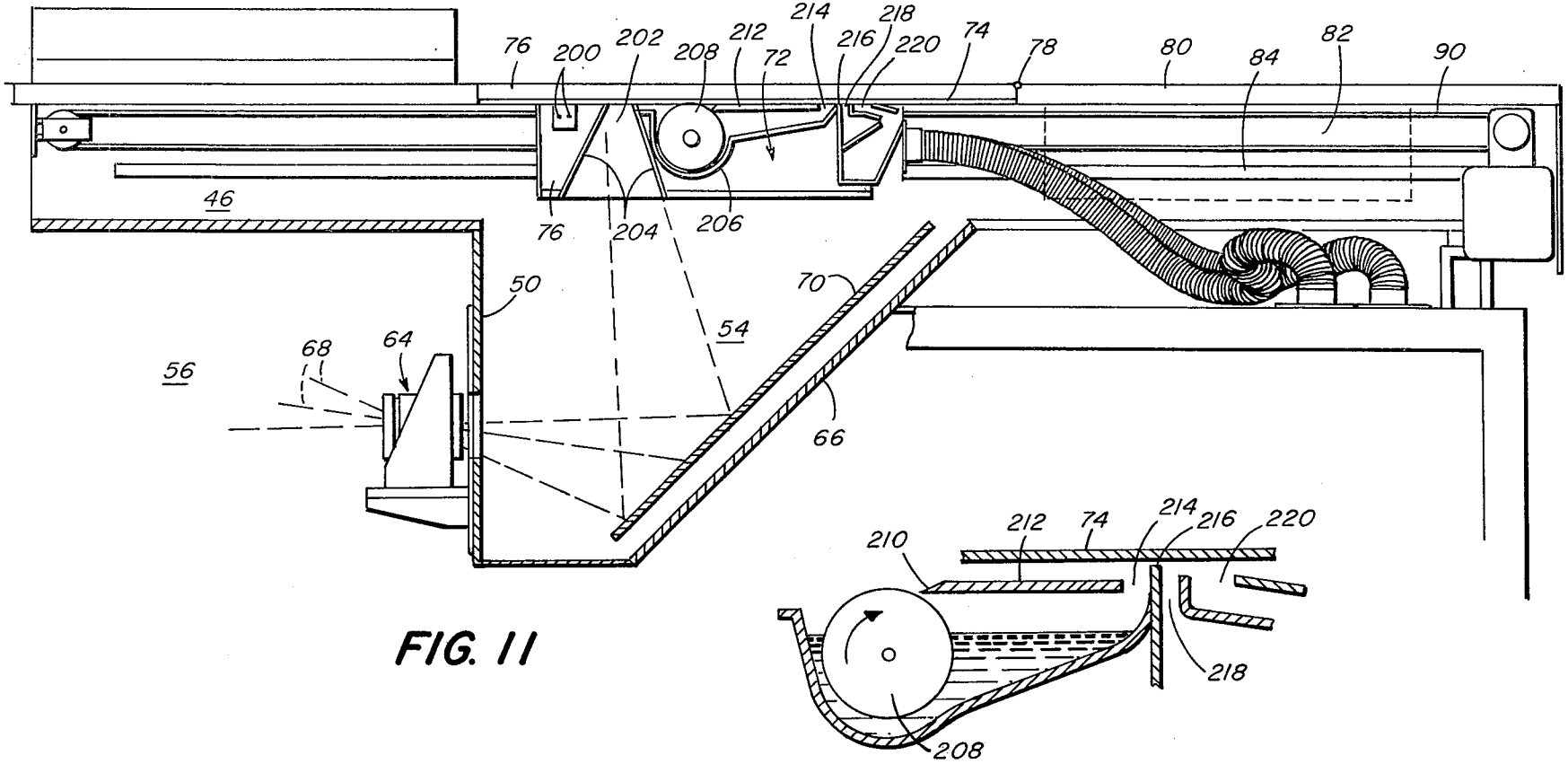
FIG. 11 is a fragmentary enlarged sectional view similar to that of FIG. 3 showing details of the charging exposing and toning carriage.
FIG. 11A is an enlarged fragmentary sectional detail of the toning arrangement of FIG. 11.
Figure 12:
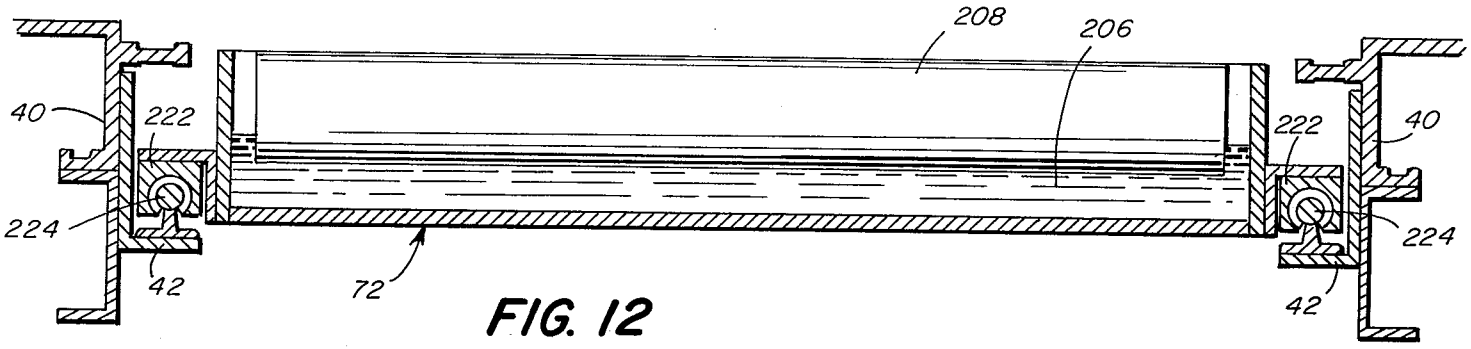
FIG. 12 is a sectional view transversely of the apparatus taken generally along the line 12—12 of FIG. 3 and in the indicated direction.

Referring also to FIG. 11A, following the slit there is a sump 206 into which liquid toner is being pumped, there being a large roller 208 rotating in the sump 206 and carrying liquid toner out of the sump to the upper exposed surface of the roller 208. At the upper side of the roller 208 there is a sharp edge 210 that is spaced very close to the roller surface so that a thick layer or wall of toner carried by the roller will be captured and swept across the upper surface of a flat plate 212 that follows the roller. This plate 212 is insulatedly mounted and has a toning bias voltage applied thereto by suitable electrical connections (not shown). The toner flows across the face of the plate 212 in a direction opposite the movement of the carriage during the making of the plate, and drops down behind the plate at the opening 214 into the sump.

The movement of the carriage carries the toner on the plate 212 close enough to the bottom surface of the electrophotographic member to engage the same so that toning will take place. When dry, the plate 212 is spaced from the member 74. Excess toner is caught by an upstanding blade 216 and sucked into a following vacuum opening 218. A blast of air is blown at the toned surface of the printing plate 74 by the nozzle 220 that follows the vacuum opening 218 so that the combination of vacuum and air pressure draws off the excess toner and helps dry the toned image.

The carriage includes side blocks 222 that engage upon rods 224 mounted to the tracks 42. A suitable drive motor drives the belts 224 extending along the tracks 42 between sheaves 228 and 230 that are clamped to the blocks 222.

The path of movement of the carriage 72 is, as explained, over the pit and then back again, from its home position 82 to its chamber 46 and then return.

The carriage is connected by pipes, conduits and wires to the various sources of voltage, storage and pumping of toner, air and vacuum, etc.

THE PLATEN-COVER

The platen-cover 24 is hinged at 78, as previously explained so that it can be swung back upon itself and faced upward to enable it to be loaded. At its front edge there is an elongate spring clamp which is indicated at 234 having a bail 236 enabling the clamp to be lifted. The surface of the platen-cover 22 which now faces upward has cross grooves and holes as shown at 238 so that vacuum may be applied to the plage 74 which is laid thereon. At the back edge of the platen, nearest to the pit, there is a magnetic edge 240 to aid in securing plates which are formed of steel to the platen. As a matter of fact magnetic material may be distributed fully around the platen if desired for this purpose.

After the plate 74 is in place, whether plastic or metal, the vacuum is turned on and the plate is held flat against the platen. This may be done before or after swinging the plate over the pit.

When the plate is in place over the pit, the imaging thereof may commence.

SEQUENCE OF EVENTS AND OPERATION

Figure 13:
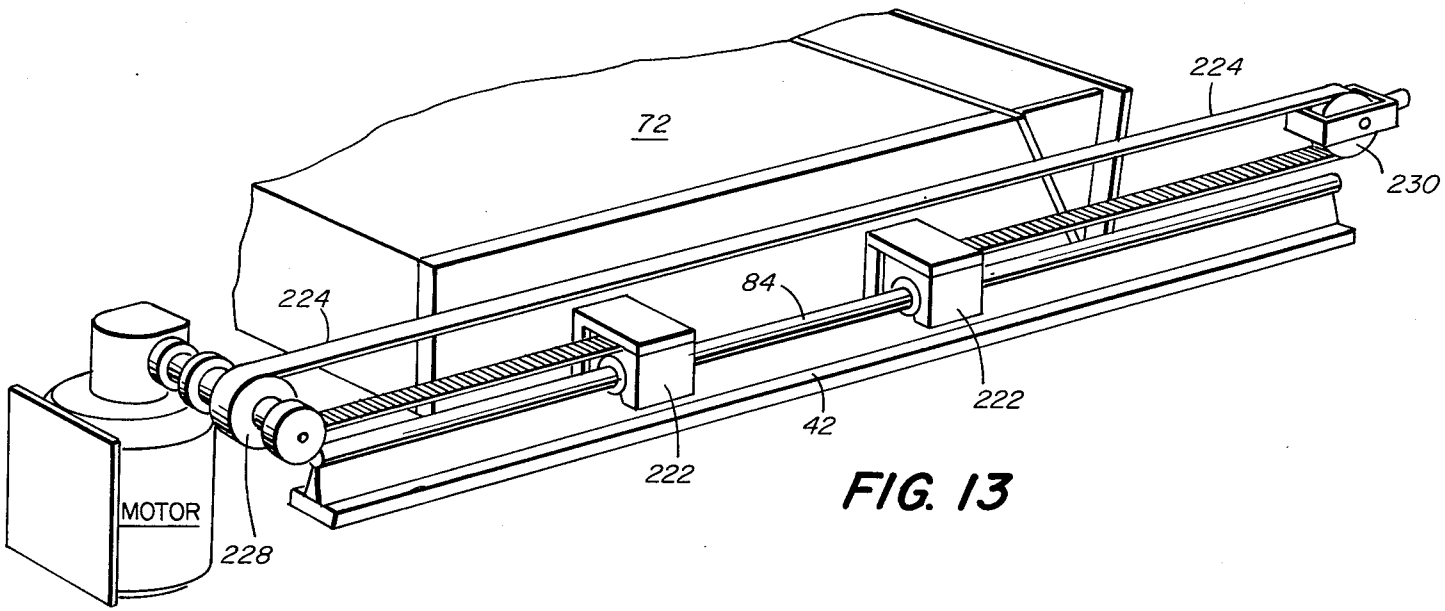
FIG. 13 is a diagram of the drive for the charging, exposing and toning carriage.
Figure 14:
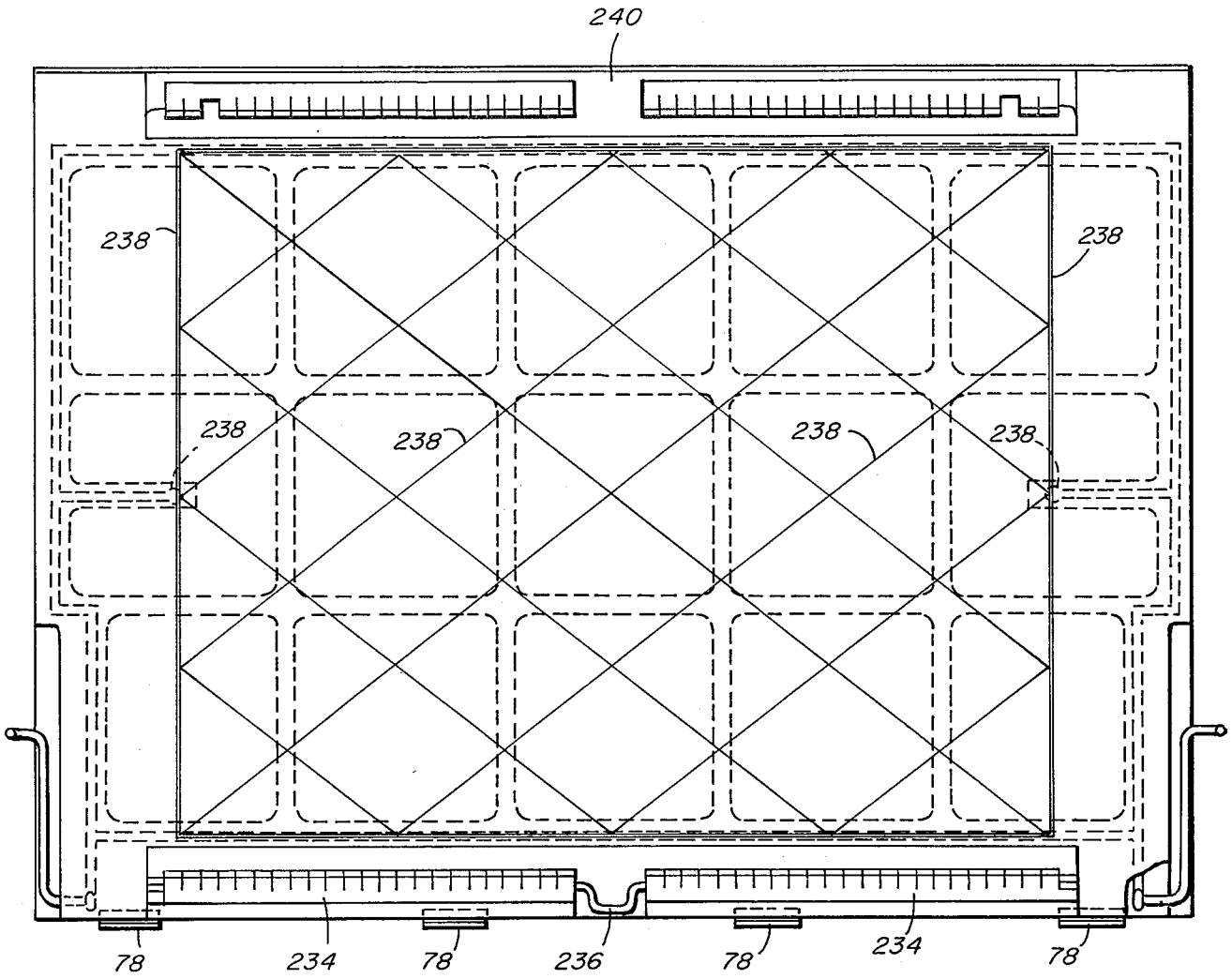
FIG. 14 is a fragmentary top plan view of the apparatus showing the right hand or platen end thereof.
Figure 15:
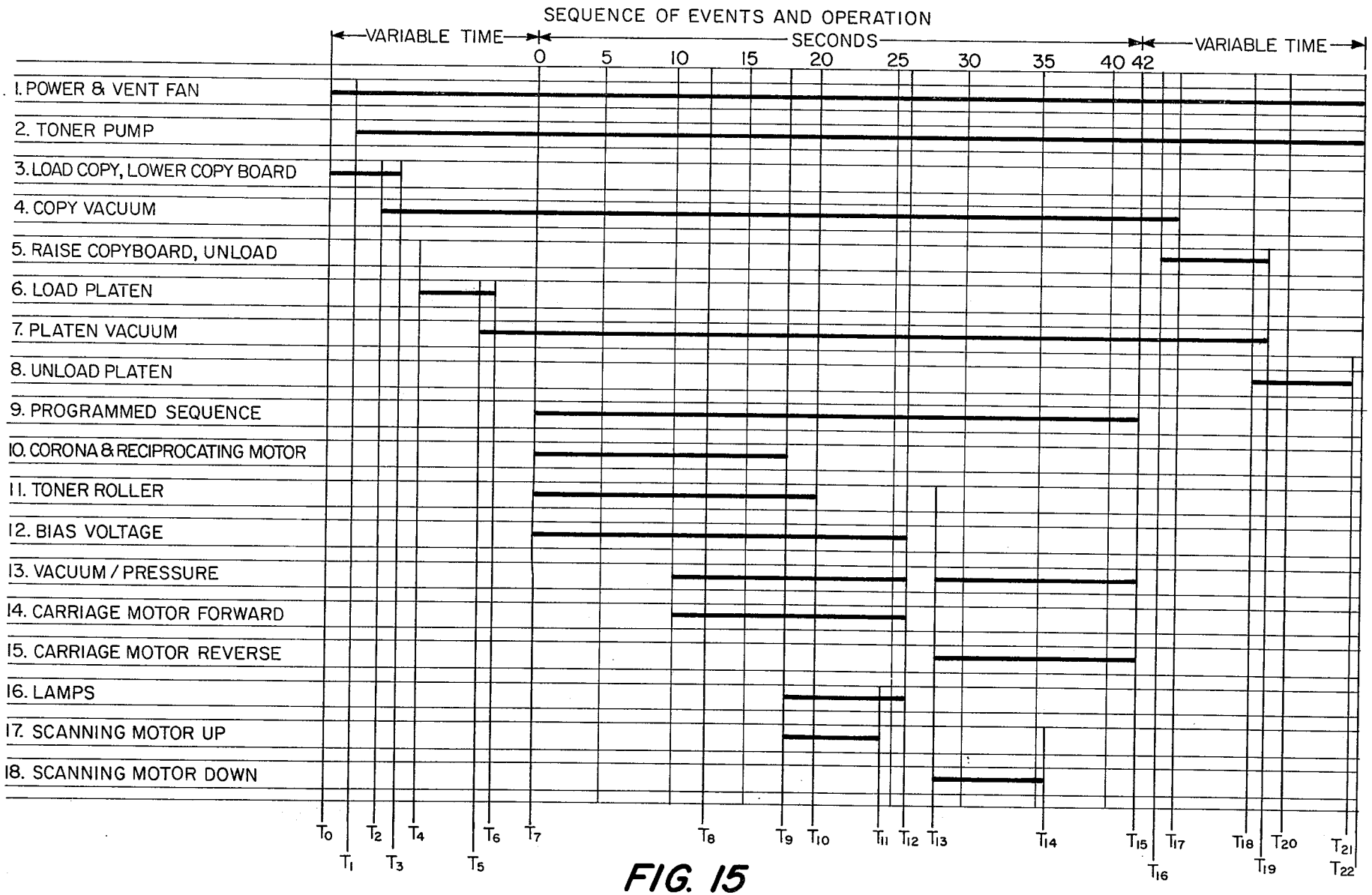
FIG. 15 is a chart showing the functions and operation of the apparatus and method, to be considered in connection with the explanation.

Attention is now invited to the chart of FIG. 13 in which a graphic representation is made of the manner in which a lithographic printing plate can be made with the apparatus 20.

In this chart the various functions will be explained with reference to time, but it should be understood that the timing periods are to a large extent dependent upon adjustments which can be made to the apparatus. It is pointed out that the operations and events can be effected by several different kinds of devices such as for example, electrical, mechanical, pneumatic and combinations thereof. The programming can be effected by relays, electrical circuits and so on. It is believed within the skill of those familiar with this art to provide the necessary control and programming components once having been taught herein what the apparatus is accomplishing.

Assuming that it is desired to make a printing plate, the copy material such as photographs, text and so on are prepared and the operator takes from stock an electrophotographic member 74.

The first step for the operator is to turn on the power and this is represented by the bar in line 1 of the chart. This is done manually by throwing a suitable switch on the control panel 48 where most of the controls and indicators are located. The energizing of the apparatus 20 is indicated by solid bar which extends from the time T0 to the time T21 when the apparatus is deenergized. Simultaneously a cooling and vent fan is energized.

After a delay of about three minutes or less to cool and ventilate the device, the toner pump starts to operate, this being indicated by the bar in line 2 which commences at the time T1 and extends to the time T21.

With these components operating, the panel 48 may display a ready light to show that the machine can be started. The next several operations of the process are manually accomplished.

Loading of the machine can be effected first at either end, that is, at the platen end or at the copyboard end. Assume for the illustration that the copyboard is to be loaded first.

The operator opens the door or cover 22 and lays it back to expose the copyboard. It the copyboard 58 is in its vertical position he will press a suitable switch or button on the control panel and bring it up to horizontal position. He unfastens the glass cover 124, puts the copy material on the glass base 118 of the copyboard 58, puts the glass cover 124 back, fastens it, closes the cover 22, then operates the apparatus to lower the copyboard to its vertical position. This last sequence of events is accomplished manually and without any timing and is indicated by line 3 and the bar there which extends from T0 to T3. T0 means that the loading could even have started before the apparatus was turned on. Before lowering the copyboard to its vertical position, the copyboard vacuum is turned on by suitable control from the panel, this action being indicated by the bar of line 4 which extends from T2 to T8.

Next the platen may be loaded and this is indicated in line 6 as occurring from T4 to T6. This is a manual procedure also, and it involves opening the platen-cover 24, placing the plate 74 in position with the aid of the clamp 234, and swinging the platen-cover 24 over the pit 54. Before swinging the platen-cover 24 closed, the plate 74 is smoothed down carefully and the vacuum turned on.

The loading of the platen is indicated by the bar of line 6 which extends from T4 to T6. The vacuum turn-on is indicated by the bar in line 7, and since the vacuum will remain operating during the time the plate is being made and until it is released, the bar in line 7 extends from time T5 just before the end of bar of line 6. The vacuum remains on until time T18 which, as will be seen, is after the plate 74 has been made and before it is unloaded.

The period between T0 and T7 is an optional one and could be several minutes. It is determined by the skill of the operator in loading the device 20. It is also determined by the requirements of the job. For example, if the pattern on the copyboard 58 is to be made up out of a plurality of pieces which have to be stuck down on the glass 118, it may require as much as half an hour to load the copyboard.

Once the copyboard 58 has been loaded and is in vertical position and its cover closed, the platen loaded and the cover 22 closed, the automatic aspect of the machine can be started. This is done at the time T7 by a suitable switch on the control panel. FIG. 13, the line 9 indicates a bar extending from T7 to T15, a time of 42 seconds. This is typical for a process from start to completion of the plate, although some of the functions performed can be adjusted to require slightly more or less time. In this case it is assumed that the speed of movement of the carriage is to be 3 inches per second.

Simultaneously with the energizing of the program sequencing means by the operator, at time T7 the corona voltage supply and the reciprocating motor for the corona wires are energized, as indicated by the bar in line 10; the toner roller commences to rotate as shown by the bar in line 11; and the toner bias voltage is applied to the plate 212, as indicated by the bar of line 12. Until steady state conditions are reached at time T8 which is 12 seconds later, this being adjustable, nothing further occurs. At time T8 the vacuum and pressure are applied (line 13) and the carriage motor is energized (line 14) driving the carriage forward.

Charging is completed less than 6 seconds later, so the corona is turned off at T9 (line 10) and the toner roller stops feeding toner over the plate 212 two second later at T10. The vacuum and pressure for removing excess toner remain in effect all the while that the carriage is moving forward, and as soon as the carriage stops at time T12, the bias voltage is removed (line 12) and vacuum and pressure are stopped (line 13).

In the meantime, the pattern has been scanned. Looking at lines 16 and 17, at the time T9 the lamps are turned on and the scanning assembly motor starts to drive the lamps upward on the copyboard. The motor stops at the time T11, about 6.5 seconds after starting, but the lamps remain lit for another couple of seconds, illuminating the top portion of the copyboard which is still being exposed through travel of the slit of the carriage. Note that at time T11 the carriage is still moving.

After exposure and toning which finishes at time T12, there is a slight delay for about two seconds to time T13 and the carriage motor reverses (line 5) to return the carriage home while the scanning assembly motor also reverses (line 18) lowering the assembly of lamps. These movements are completed at the times T15 and T14, respectively. The stroke of the scanning assembly movement is much shorter than that of the carriage movement.

The line 13 indicates that the vacuum and pressure means operate from T13 and T15 during the carriage return stroke. This is to clean the upper surface of the carriage for the next cycle. The forward position of the carriage is in the chamber 46. At the top entrance to the chamber there is a squeegee which engages the bias plate 112 to scrape excess toner off that plate, expecially on the return stroke. The vacuum and pressure work in cooperation with this squeegee to clean the bias plate.

The automatic sequence of events is complete at the time T15. Thereafter, manually operated events are effected. At time T16, the operator will throw a switch to raise the copyboard and commence to unload it, assuming this is to be done. He may leave the copyboard vertical to "shoot" another plate. He is finished at time T20 (line 5). In the meantime he has shut off the vacuum to the copyboard at T17.

The vacuum to the platen is shut off at T18, the platen opened at T19 (line 8) and the plate removed by the time T21. After everything has been done, the apparatus power is turned off at T22.

There may be two operators loading and unloading the apparatus in which case the timing bars in lines 3,5,6 and 8 will overlap a good part. Interlock switches placed to prevent operation of the automatic sequence provide a measure of safety. For example, there can be switches associated with the covers, a switch to prevent operation if the copyboard is not vertical, etc.

As stated, timing and programming can be achieved in many ways. One simple manner would be to have a rotary switch or sequencing switches or relays, operating in conjunction with microswitches disposed along the paths of movement of the carriage and the lamp scanning assembly. These are readily devised by those skilled in this art.

CONCLUSION

The plate which emerges from the apparatus 20 is not completed for use in an offset lithographic press. Its toner may have been fused in the apparatus, but this is not essential for reasons given. If there is a fuser, it could be located on the carriage or elsewhere and programmed to operate at the end of the cycle. A separate device alongside of the apparatus 20 could accept the plate 74, fuse it, and immerse it in an etchant such as those disclosed in the copending applications.

The important feature of the invention is that the plate 74 is made directly from the copy original without any of the complex processes needed for conventional plates. Everything takes place in ambient light except the actual exposure within the apparatus 20. The electrophotographic members are handled in ambient light, loaded in ambient light, removed from the apparatus in ambient light and treated in ambient light.

Many variations are capable of being made without departing from the spirit or scope of the invention as defined in the appended claims.

What is desired to secure by Letters Patent of the United States is:

1. Apparatus for producing a toned image on an electrographic member for the purpose of making said member into a lithographic printing plate or for other use directly from a pattern which comprises:

A. an enclosure having a copyboard and a platen,

B. means for mounting a pattern on the copyboard and for securing an electrophotographic member on the platen with a photoconductive surface exposed, C. movable means associated with the copyboard for progressively illuminating the pattern on the copyboard with radiant energy portion by portion, D. means within the enclosure including a fixed optical train for projecting the radiant energy from the pattern to the exposed photoconductive surface, E. a carriage in the enclosure adapted to move in one direction across the photoconductive surface and having charging means, a slit and toning means arranged in that order, the carriage obstructing the photoconductive surface from said projected radiant energy when it is moving in said one direction but for the slit and F. means for operating the progressive illuminating means and for moving said carriage in said one direction substantially continuously and in synchronism whereby to image the electrophotographic member with said pattern by charging, exposing and toning transverse areas of said photoconductive surface progressively over its full extent as the carriage moves in said one direction.

2. The apparatus as claimed in claim 1 in which the electrophotographic member is mounted with its photoconductive surface facing downward while it is being imaged, the toning means including an upwardly facing liquid toner carrying member which is spaced from the electrophotographic member when dry but is sufficiently close thereto so that the meniscus of a layer of liquid toner flowed thereon will contact the photoconductive surface.

3. The apparatus as claimed in claim 1 in which the toning means include a flat metal plate, a sump and a toner roller in the sump adjacent an edge of the plate, the roller adapted to be rolled during at least a part of the movement of the carriage to bring toner from the sump and discharge same onto said plate whereby the meniscus of said toner on the plate will cause toner to wet the exposed photoconductive surface.

4. The apparatus as claimed in claim 1 in which said toning means includes a bias plate and a voltage is applied to said bias plate as the carriage is moving in said one direction to image said electrophotographic member.

5. The apparatus as claimed in claim 2 in which said toner carrying member comprises a metal plate arranged to move parallel with said electrophotographic member and a voltage is applied to said metal plate to provide a toning bias when the carriage is moving is said one direction and toner is being applied to image the electrophotographic member.

6. The apparatus as claimed in claim 3 in which a voltage is adapted to be applied to said flat metal plate while said carriage is moving in said one direction whereby to provide a toning bias during imaging.

7. The apparatus as claimed in claim 1 in which said carriage in addition is provided with excess toner removing means following the toning means.

8. The apparatus as claimed in claim 7 in which said enclosure has a source of vacuum and there is a first flexible connection between said source to said carriage, said excess toner removing means including a vacuum slot coupled with said source by way of said first flexible connection.

9. The apparatus as claimed in claim 8 in which said excess toner removing means include a nozzle following the vacuum slot, the enclosure includes a source of air pressure and there is a second flexible connection between said air pressure source and the carriage, said nozzle being coupled with said source by means of said second flexible connection, said nozzle being directed at the area of said electrophotographic member which has just previously been toned while the carriage is moving in said first direction and cooperating with said vacuum slot to remove excess toner while tending to dry if not fully drying the toner deposited on said electrophotographic member.

10. The apparatus as claimed in claim 8 in which the toning means include a bias plate adapted to have a bias voltage applied thereto during movement of the carriage in said first direction, in which there is a sump for liquid toner and means to bring the liquid toner from said sump to said bias plate and to flow the same over the surface of the bias plate during said movement in said first direction to enable application of said toner to said electrophotographic member, the bias plate being located between the slit and vacuum slot.

11. The apparatus as claimed in claim 10 in which the electrophotographic member faces downward when mounted to said platen and the bias plate faces upward and is spaced from said platen by a distance such that when the electrophotographic member is in place it will also be spaced therefrom by a distance less than the meniscal height of the liquid toner that is adapted to flow onto said plate.

12. The apparatus as claimed in claim 1 in which the platen is arranged horizontally and facing downward during the period of time that the carriage is moving in said first direction, the progressively illuminating means comprising a scanning assembly including radiant energy source means directed at least at one surface of the copyboard for illuminating said pattern to be viewed by said projecting means, said enclosure having track means defining a path for said carriage including a home position at which the slit is disposed in advance of the platen and a terminal position at which the slit has fully passed over the platen to have imaged an electrophotographic member on said platen as aforesaid, said scanning assembly being mounted for movement between an initial position adjacent one end of said copyboard and a final position adjacent the other end of said copyboard, said means for operating the progressive illuminating means comprising drive means for moving the scanning assembly from the initial position to the final position, said moving means for the carriage and drive means for the scanning assembly being arranged to return the carriage and scanning assembly to their respective home position and initial position after imaging but not necessarily in synchronism.

13. The apparatus as claimed in claim 1 in which the platen is arranged horizontally and facing downward during the period of time that said carriage is moving in said first direction, said copyboard is at the same time arranged vertically, said illuminating comprises a scanning assembly including radiant energy source means directed at least at one surface of said copyboard for illuminating said pattern to be viewed by said projecting means, the scanning assembly has an initial position at the bottom of the copyboard and a final position at the top of the copyboard, and the means for operating the illuminating means also acting to drive the scanning assembly upward from initial position to final position during the same period of time that the carriage is moving horizontally in said first direction.

14. The apparatus as claimed in claim 13 in which the enclosure has track means for guiding said carriage in its horizontal movement, there being a home position of said carriage at one end of said track means and at the beginning of its horizontal movement in said one direction and a terminal position of said carriage at the other end of said track means which is reached by the carriage after said slit has passed fully over said platen while moving in said first direction, the operating means and carriage moving means serving to return the carriage horizontally from its terminal to its home position in the opposite direction and to return the scanning assembly downward from its final to its initial position after the imaging of an electrophotographic member carried on said platen.

15. The apparatus as claimed in claim 14 in which said radiant energy source means is enabled during the movement of said scanning assembly upward from the initial to the final position and is disabled during movement downward from the final to the initial position.

16. The apparatus as claimed in claim 15 in which the radiant energy source remains enabled for a short period of time after the scanning assembly has reached its final position, the movement of the carriage horizontally in said first direction while the slit is passing over the platen also being for a period of time after the movement of the scanning assembly upward has been discontinued.

17. The apparatus as claimed in claim 15 in which at least the charging means and toning means are rendered inoperative as the carriage is moving horizontally in said opposite direction.

18. The apparatus as claimed in claim 1 in which the copyboard is disposed vertically during operation of the progressive illuminating means, the enclosure has a top opening in the vicinity of the copyboard, means are provided for moving the copyboard between said vertical position and a position in which it is substantially horizontally arranged at least adjacent if not within the enclosure top opening so that it is available for mounting said pattern by an operator prior to imaging, said copyboard moving means including a framework connected with said enclosure on the interior thereof and the framework and copyboard having cooperating follower and guide means and a driving device coupled with said follower and guide means.

19. The apparatus as claimed in claim 1 in which the copyboard is disposed vertically during operation of the progressive illuminating means, the enclosure has a top opening in the vicinity of the copyboard, means are provided for moving the copyboard between said vertical position and a position in which it is arranged horizontally at least adjacent if not within the enclosure top opening so that it is horizontally available for mounting said pattern by an operator prior to imaging, said copyboard moving means including guides defining the path of movement, follower means mounted to the copyboard and drive means connected with said follower means for moving same within said guides.

20. The apparatus as claimed in claim 19 in which the guides comprise vertical support members connected with said enclosure and disposed to straddle the copyboard during its movements, a vertical slot in each support member, said follower means including a truck confined in each vertical slot, the trucks being pivotally connected with the copyboard on opposite side edges thereof and close to the center of the said side edges, an arcuate slot in each support member including a horizontal portion and a connected vertical portion, the vertical portions of the arcuate slots being spaced from and parallel with the said vertical slots and the follower means also including a roller mounted on each of said opposite side edges of said copyboard but adjacent one end thereof, each of said rollers being engaged in a respective arcuate slot.

21. The apparatus as claimed in claim 18 in which said framework includes a pair of vertical standards integral therewith, the copyboard being located between the standard while in its vertical disposition and one of the follower and guide means being mounted to said standards.

22. The apparatus as claimed in claim 21 in which the progressive illuminating means comprise an elongate scanning assembly coupled with said vertical standards having at least a lamp and reflector facing the pattern of the copyboard, said standards and the ends of said assembly having second guide and follower means, said second guide and follower means being arranged to move the scanning assembly parallel with the copyboard vertically, movement of the copyboard between horizontal and vertical positions being independent of the scanning assembly.

23. The apparatus as claimed in claim 22 in which rotary drive means are provided for driving the scanning assembly in its vertical movement, means are provided for energizing the rotary drive means and means are provided for preventing energizing of said rotary drive means unless said copyboard is arranged in its vertical disposition.

24. The apparatus as claimed in claim 18 in which locating pins and guide openings are provided on said copyboard and the bottom of said enclosure adapted to be engaged when said copyboard is in its vertical disposition for locating said copyboard optically relative to said projecting means for optimum focus.

25. Apparatus for producing a toned image on an electrophotographic member directly from a pattern comprising:

A. a chassis having a copyboard and a platen mounted thereon and including means for enclosing the platen against ambient light, B. means for mounting a pattern on the copyboard and for loading an electrophotographic member on the platen with a photoconductive surface thereof exposed, the platen being arranged to be loaded facing outwardly of the chassis and movable to a position in which it is horizontal and facing inwardly of the chassis, C. means associated with the copyboard for progressively illuminating the pattern on the copyboard with radiant energy, D. means within the chassis and normally light tight for projecting the radiant energy from the pattern to the exposed photoconductive surface, E. a carriage in the chassis and also enclosed normally from ambient light adapted to move across the photoconductive surface and having charging means, a slit and toning means arranged in that order, the carriage obstructing the photoconductive surface from said projected radiant energy when it is moving but for the slit, F. means for driving the carriage in a first direction horizontally across the photoconductive surface between a home and terminal position during an imaging stroke and for driving the carriage back from terminal to home position in a return stroke, G. said progressively illuminating means including a movable scanning assembly, radiant energy source means carried on the assembly and a driving device for moving the assembly from an initial position to a final position scanning the copyboard and any pattern thereon while energizing said radiant source means and for returning said assembly from the final position to the initial position while disabling the radiant energy source means, H. the scanning assembly and carriage moving substantially synchronously while the radiant energy source means is energized and the carriage is moving in said first direction, the charging means and toning means being operative while the carriage is moving in said first direction whereby to image the electrophotographic member with said pattern by charging, exposing through said slit and toning a transverse area thereof progressively over its full extent as the carriage moves toward its terminal position.

26. The apparatus as claimed in claim 25 in which the copyboard is disposed vertically during movement of the scanning assembly and the radiant energy projecting means include an optical deviating device to change the direction of the rays of radiant energy projected from said pattern from generally horizontal to generally vertical, the geometric arrangement of the scanning assembly and the carriage being such that the principal intensity of the moving illumination will be directed at said slit during the movement of the carriage in said first direction.

27. The apparatus as claimed in claim 26 in which the total distance travelled by the carriage during exposing the platen is greater than the total distance travelled by the scanning assembly in moving from its initial to its final position and the radiant energy source means are energized while the carriage continues moving for a short time after the scanning assembly has reached its final position.

28. The apparatus as claimed in claim 26 in which the initial position of the scanning assembly is at the bottom end of the copyboard and the final position is adjacent the top end thereof.

29. The apparatus as claimed in claim 25 in which the projecting means include a vertically arranged pit having an entrance opening to the top of the chassis, the platen is mounted on a door that is hinged to the chassis at said enclosing means and is adapted to be swung between two positions, one of which is against the top of the chassis alongside of the pit entrance with the platen facing upward and the other of which is engaged over the entrance closing same off and with the platen facing downward.

30. The apparatus as claimed in claim 19 in which the progressive illuminating means comprise an elongate scanning assembly coupled with said vertical standards having at least a lamp and reflector facing the pattern of the copyboard, said standards and the ends of said assembly having second guide and follower means, said second guide and follower means being arranged to move the scanning assembly parallel with the copyboard vertically, movement of the copyboard between horizontal and vertical positions being independent of the scanning assembly.

31. Apparatus for producing a toned image on an electrophotographic member for the purpose of making said member into a lithographic printing plate or the like directly from a pattern which comprises:

A. an enclosure having a framework which includes a track adjacent the top thereof at one end and a guideway adjacent the top at the second end thereof, B. a platen for mounting an electrophotographic member at the second end and the platen being formed in a hinged door and adapted to be swung to a position facing into the enclosure alongside of said guideway, C. a carriage in said guideway including in sequence a charging corona device, a slit and toning means, the apparatus including means for driving the carriage in said guideway between a home position at one end of the platen to a terminal position at the other end of said guideway while said corona device is energized and said toning means is operating, the carriage adapted to be moved parallel to the downward facing platen so that the slit scans the platen, the driving means being effective to return the carriage to its home position, D. a projection camera incorporated in said apparatus, mounted to said framework within said enclosure and including a central optical lens system whose axis is generally horizontal, a projection pit which is vertical and an angled reflector arranged to deviate rays of light coming through said lens system upward in said pit, the downwardly facing the platen being aligned with and the guideway straddling the upper end of the pit whereby the movement of the carriage will capture light from the reflector and apply the same to said platen, E. a copyboard structure comprising a pair of standards, slots in the standards including a vertical and an arcuate slot in each, a copyboard, follower means in the slots and connected with the copyboard, means for translating the follower means in the slots to move the copyboard between a horizontal position adjacent the track and a vertical position generally perpendicular to the said axis of the lens system, F. means for illuminating the copyboard progressively while in said vertical position simultaneously with movement of the carriage from its home to its terminal position and G. said standards being engaged on said track and adjustable therealong whereby to focus a pattern which may be carried on said copyboard with respect to the projection camera and the platen.

32. The apparatus as claimed in claim 31 in which the illuminating means include a scanning assembly coupled with said standards, arranged to move vertically relative thereto and the standards including drive means for moving the assembly.

33. The apparatus as claimed in claim 32 in which the copyboard structure and the illuminating means are comprised along with said standards as a module which is adapted to be assembled independently of the framework and thereafter mounted to the framework, said apparatus including means for clamping the module in said focussed position.

34. A method of imaging an electrophotographic member from a pattern which is carried on a copyboard, the electrophotographic member being mounted on the surface of a platen, which comprises:

A. disposing the platen to face downwardly,

B. disposing the copyboard vertically to face horizontally, generally toward a vertical axis generally normal to the center of the platen, C. providing a carriage which has charging means, a slit and toning means, D. passing the carriage across the bottom face of the platen to block light directed upward toward the platen but for the scanning action of the slit, E. moving illuminating means in a vertical direction over the surface of the copyboard substantially in synchronism with the movement of the carriage while energizing said charging means and toning means, F. projecting the portions of the copyboard illuminated by said illuminating means horizontally toward said vertical axis below said carriage and G. deviating the projected portions upward toward said platen and following the slot whereby progressively to image the electrophotographic member on said platen with whatever pattern is carried on said copyboard.

35. The method as claimed in claim 34 which includes progressively to remove excess toner from the image following its being toned.

36. The method as claimed in claim 34 in which the copyboard is transparent and both the rear and front surfaces of the copyboard are illuminated simultaneously such that the portions projected include some derived from the rear illumination.

37. The method as claimed in claim 34 in which prior to disposing the copyboard vertically it is disposed horizontally, said pattern is applied thereto and thereafter it is moved to said vertical disposition, the passing of the carriage across the face of the platen and the moving of the illuminating means being delayed until the copyboard has reached said vertical disposition.

38. The method as claimed in claim 35 in which said excess toner is removed by suction.

39. The method as claimed in claim 35 in which said excess toner is removed by a combination of suction and air pressure.

40. The method as claimed in claim 34 in which simultaneously a toning bias voltage is applied to said toning means during the energizing thereof.

41. Apparatus for producing a toned image on an electrophotographic member directly from an article or articles forming a pattern which comprises:

A. an enclosure having a copyboard structure adjacent one end and means comprising an opening to the top of the enclosure to give access to the copyboard structure, E. a platen at the top of the enclosure adjacent the other end and said platen being incorporated into a swinging door as the interior of the door, the door being hinged to the top of the enclosure, C. means forming a vertical pit in the enclosure between the ends thereof and said pit having an upper entrance opening to the top of the enclosure and adapted to have said entrance closed off by said door when the platen is swung over said entrance, D. the platen having means for securing an electrophotographic member to the platen with a photoconductive surface of said electrophotographic member exposed for receiving radiant energy, the platen being moved to face downward and over the pit when the door is closed on said entrance, E. optical projecting means between the pit and the copyboard structure, F. a reflector on an inner surface of said pit and adapted to receive rays of radiant energy from said projecting means and deviate same to said entrance, G. means for mounting the pattern on the copyboard and means for scanning the pattern with a source of radiant energy to illuminate said pattern progressively, H. a carriage guided for movement parallel to said platen when the platen is disposed over the pit and having charging means, a through slit and toning means arranged thereon in that order, the carriage obstructing the deviated rays from impinging directly against said electrophotographic member except through said slit, I. means for moving the carriage substantially in synchronism with the scanning of the pattern whereby progressively to reproduce said pattern on said electrophotographic member, and J. said enclosure having means for applying a corona voltage and a continuous flow of toner to said toner means during movement of said carriage.

42. The apparatus as claimed in claim 41 in which the carriage has excess toner removing means located following the toning means and comprising a vacuum slot, the enclosure has a source of vacuum and there is a flexible conduit between said source of vacuum and the vacuum slot whereby the vacuum may be applied to said slot while said carriage is moving.

43. The apparatus as claimed in claim 42 in which the excess toner removing means includes also an air nozzle, the enclosure has a source of air pressure and there is a second flexible conduit between said source of air pressure and the air nozzle, the air nozzle being disposed to direct a blast of air against the platen at the location of the vacuum slot, the second flexible conduit enabling such air nozzle to operate while the carriage is moving.

44. The apparatus as claimed in claim 40 in which the means to apply a continuous flow of toner to said toner means comprising a store and pump for liquid toner in the enclosure and flexible toner conduits extending from said store and pump to said carriage.

45. The apparatus as claimed in claim 43 in which the means to apply a continuous flow of toner to said toner means comprising a store and pump for liquid toner in the enclosure and flexible toner conduits extending from said store and pump to said carriage.

46. The apparatus as claimed in claim 45 in which the toner conduits are coaxial with at least one of said flexible vacuum and air pressure conduits.

47. A module for attachment to an apparatus for producing a toned image on an electrophotographic member, said apparatus without said module including a platen adapted to receive an electrophotographic member thereon to be imaged, a carriage having a charging device, a slit and toning means arranged thereon in sequence and there being means to move the carriage over the surface of the platen to have the slit scan the same, a camera structure which includes a horizontally arranged lens system, a projecting pit below the platen and a reflector in the pit against which the illumination captured by the lens system is deviated upwardly and directed at the slit, the apparatus also including a track structure for supporting the module and the said module comprising:

A. a rectangular horizontally disposed frame member having a pair of depending opposite standards, B. a copyboard adapted to have a pattern applied thereto, the copyboard having roller means on opposite side edges thereof, C. slotted guides in the standards cooperating with said roller means to define two positions to which the copyboard is capable of being moved, one of which is horizontally spaced within said frame member and the other of which is vertically aligned with said lens system, D. means on the frame for moving the copyboard between said two positions, E. an illumination carriage mounted to said standards and arranged to move vertically to illuminate said copyboard in a scanning action, F. means on the frame for moving the illumination carriage, G. the frame having means for mounting the frame on said track structure and adjusting the position of the copyboard relative to said lens system when said copyboard is vertical for any desired condition of focus of said camera structure for said pattern upon said platen.

* * * * *